US006088869A

United States Patent [19]

Kaneda et al.

[11] Patent Number: 6,088,869

[45] Date of Patent: Jul. 18, 2000

[54] TOOTHBRUSH

[75] Inventors: Takayuki Kaneda; Mitsuyuki Kubo; Toshiro Shintani, all of Tochigi, Japan

[73] Assignee: Kao Corporation, Tokyo, Japan

[21] Appl. No.: 09/147,267

[22] PCT Filed: May 8, 1997

[86] PCT No.: PCT/JP97/01550

§ 371 Date: Nov. 16, 1998

§ 102(e) Date: Nov. 16, 1998

[87] PCT Pub. No.: WO97/42853

PCT Pub. Date: Nov. 20, 1997

[30] Foreign Application Priority Data

| | | | |
|---|---|---|---|
| May 20, 1996 | [JP] | Japan | 8-124421 |
| May 14, 1996 | [JP] | Japan | 8-118745 |
| Aug. 23, 1996 | [JP] | Japan | 8-222080 |

[51] Int. Cl.[7] ..... A46B 9/04; A46B 3/16

[52] U.S. Cl. ..... 15/167.1; 15/110; 15/195; 15/207.2; 15/DIG. 5

[58] Field of Search ..... 15/110, 167.1, 15/195, 207.2, DIG. 5

[56] References Cited

U.S. PATENT DOCUMENTS

| | | | |
|---|---|---|---|
| 3,229,318 | 1/1966 | Clemens | 15/167.1 |
| 4,475,261 | 10/1984 | Okumura et al. | 15/195 |
| 5,500,975 | 3/1996 | Sano | 15/167.1 |
| 5,533,227 | 7/1996 | Ito et al. | 15/167.1 |

FOREIGN PATENT DOCUMENTS

| | | |
|---|---|---|
| 247224 | 12/1987 | European Pat. Off. . |
| 61-10495 | 4/1986 | Japan . |
| 63-31640 | 8/1988 | Japan . |
| 5-15834 | 3/1993 | Japan . |
| 7-284412 | 10/1995 | Japan . |
| 96/25866 | 8/1996 | WIPO . |

*Primary Examiner*—Mark Spisich

*Attorney, Agent, or Firm*—Oblon, Spivak, McClelland, Maier & Neustadt, P.C.

[57] ABSTRACT

A toothbrush comprises a plurality of tufts each including a plurality of bristles embedded respectively in a plurality of bored holes formed in a head portion. The tufts each comprise a plurality of first bristles tapered towards distal ends thereof, and a plurality of second bristles likewise tapered towards the distal ends and each having a ball-like portion on each of the distal ends thereof. The distal ends of the first bristles are located in a higher position than the distal ends of the second bristles.

7 Claims, 8 Drawing Sheets

12a
12

12a
12

12a
12

12a
12

12a
12

TOOTHBRUSH

TECHNICAL FIELD

The present invention relates to a toothbrush, and more particularly to a toothbrush which is excellent in performance with regard to the cleansing of surfaces of teeth and gums, the areas between adjoining teeth, and the marginal areas between the teeth and the gums. The toothbrush of the present invention is also excellent in performance with regard to the massaging of gums, is comfortable in the sense of feel, and is satisfactory in providing a long service life.

BACKGROUND ART

Ordinary toothbrushes are chiefly designed for the purpose of cleansing the surfaces of the teeth and gums, the areas between adjoining teeth (the areas between adjoining teeth are hereinafter referred to as "interproximal areas") and the marginal areas between the teeth and the gums (the marginal areas are hereinafter referred to as the "periodontal areas"), and removing dental plaque in the interproximal areas and the periodontal areas. This performance is hereinafter referred to as "cleansing performance". Also, the brushing with a toothbrush provides a massaging effect against the gums. Massaging the gums is known to be remarkably effective in preventing periodontitis or gumboil. This massaging effect is also one of the objects of toothbrush devices. In order to improve the cleansing performance, various types of toothbrushes have heretofore been proposed.

One such example is disclosed in Japanese Utility Model Publication No. Sho 61-10495 in which a toothbrush has tapered bristles and non-tapered bristles alternately embedded. The tapered bristles cleanse the interproximal areas and/or the periodontal areas, while the non-tapered bristles cleanse the surfaces of the teeth and gums. However, this toothbrush does not take into consideration a massaging effect against the gums. Therefore, the cleansing performance and massaging effect were left incompatible.

Another Japanese Utility Model Publication No. Sho 63-31640 discloses a toothbrush in which non-tapered bristles having ball-like distal ends of different height are embedded such that the distal ends are steppingly arranged, so that the massaging effect will be enhanced. However, since this toothbrush has non-tapered bristles having ball-like distal ends, the distal end portions are difficult to flex. Moreover, it has room for improvement with respect to the removal of plaque and a massaging effect.

Another Japanese Laid-Open Utility Model Application No. Hei 5-15834 discloses a toothbrush having bristles which are all tapered. This toothbrush is not sufficient in stiffniess as a whole and its bristles tend to overly flex. Accordingly, in spite of its comfortableness in sense of feel, it has deficiencies in cleansing performance and massaging effect.

Furthermore, Japanese Laid-Open Patent Application No. Hei 7-284412 and U.S. Pat. No. 5,500,975 disclose a toothbrush in which two types of bristle end forms, one being of a ball-like shape and the other being of a tapered shape, are folded into two parts and embedded in bored holes respectively. This toothbrush has, indeed, the advantages that the ball-like end form of its bristles provides a good massaging effect to the gums and a good plaque scraping-off effect, and that the tapered end form provides a good plaque-removing effect from the periodontal pocket. However, in spite of those advantages, this toothbrush has the deficiencies that the bristles having the ball-like end form are more difficult to be flexed than the bristles having the tapered end form, and that the first-mentioned group of bristles having the ball-like end form are degraded in sense of feel and comfortableness. Moreover, this toothbrush is also not satisfactory with respect to long service life.

The inventors of the present invention have studied very hard in order to overcome the above-mentioned deficiencies and finally succeeded in the development of a toothbrush capable of overcoming those deficiencies. It is, therefore, an object of the invention to provide a toothbrush which is excellent in performance with respect to the cleansing of surfaces of the teeth and gums, the areas between adjoining teeth, and the marginal areas between the teeth and the gums, and excellent in performance with respect to the massaging of gums, is comfortable in sense of feel, and is satisfactory in providing a long service life.

DISCLOSURE OF INVENTION

According to a feature of the present invention, there is provided a toothbrush comprising: a plurality of tufts each comprising a plurality of bristles embedded respectively in a plurality of bored holes formed in a head portion of the toothbrush. Each of said tufts comprises a plurality of first bristles tapered towards distal ends of the first bristles, and a plurality of second bristles tapered towards distal ends of said second bristles. Each of said second bristles has a ball-like portion on each of the distal ends of the second bristles. The distal ends of said first bristles are located at a higher position than the distal ends of said second bristles.

According to a further feature of the present invention, said first bristles and said second bristles have a surface roughness of Ra=0.5 $\mu$m to 1.51 $\mu$m at those areas from 30% to 80% of an overall length from the distal ends of the first bristles and the second bristles.

According to a further feature of the present invention, a step between the distal ends of said first bristles and the distal ends of said second bristles is in a range from 0.5 mm to 4.0 mm.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings wherein.

BEST MODE FOR CARRYING OUT THE INVENTION

Figure 1:
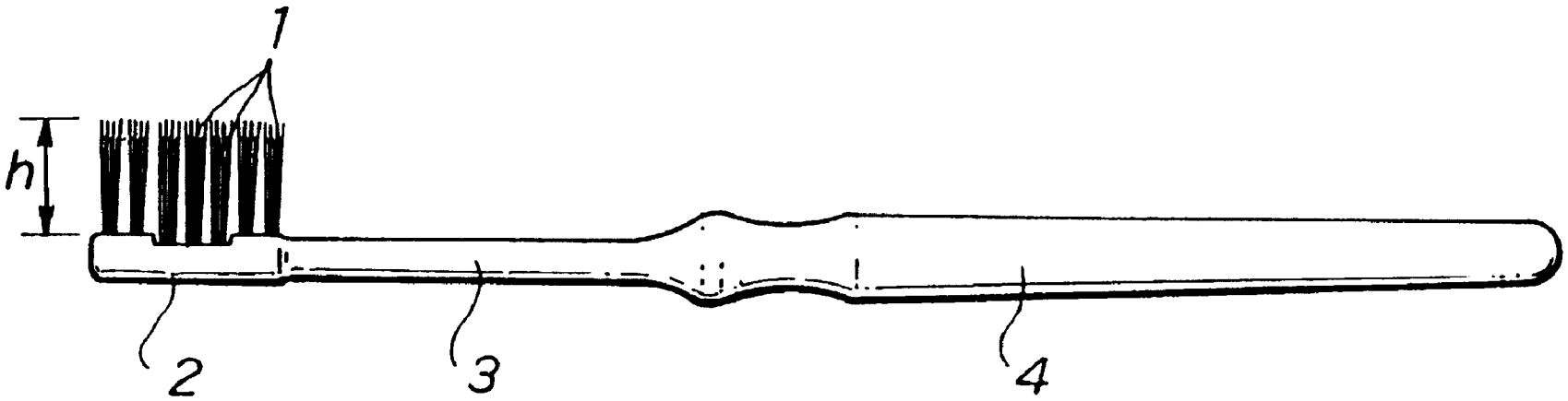
FIG. 1 is a side view showing one embodiment of a toothbrush according to the present invention.
Figure 3:
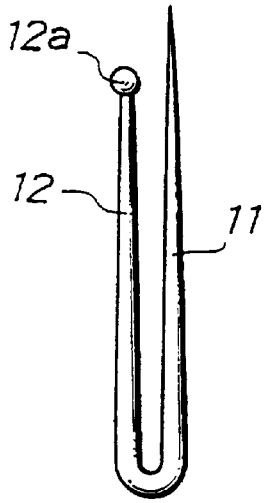
FIG. 3 is a side view showing bristles in the toothbrush according to the present invention.
Figure 4:
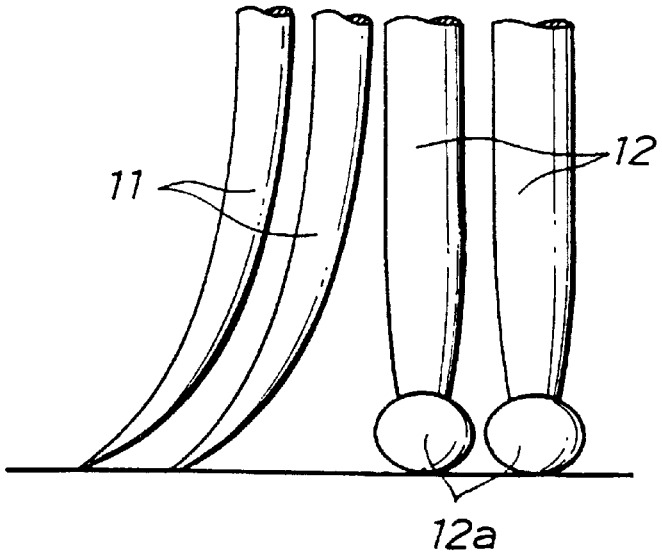
FIG. 4 is a side view showing distal end portions of the first and second bristles when brushing is made in the above one embodiment of the toothbrush according to the present invention.
Figure 5E:
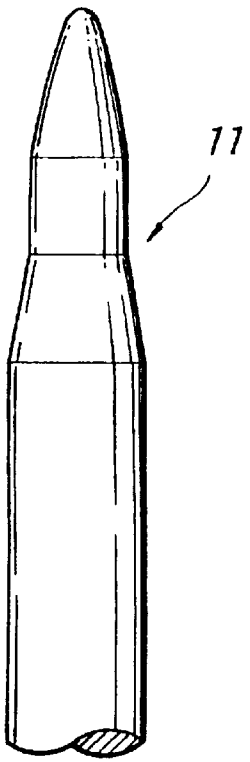
FIGS. 5(*a*)–5(*e*) are side views showing various shapes of tapered bristles in the toothbrush according to the present invention.
Figure 5D:
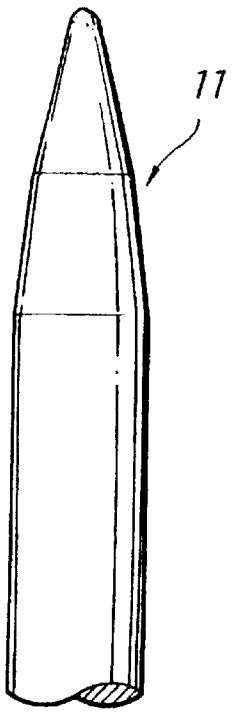
Figure 5C:
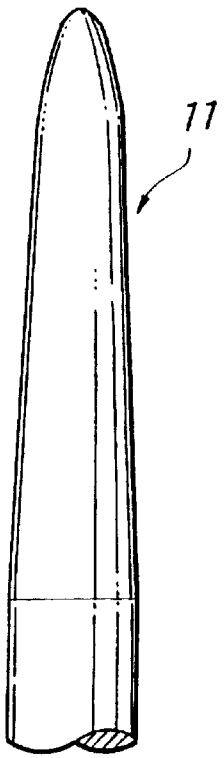
Figure 5B:
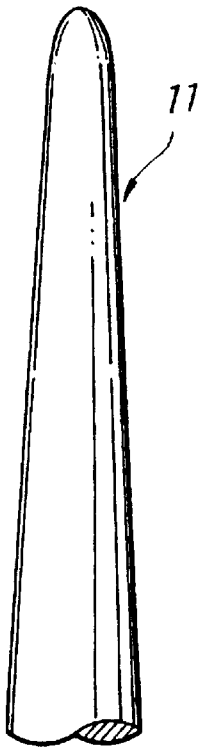
Figure 5A:
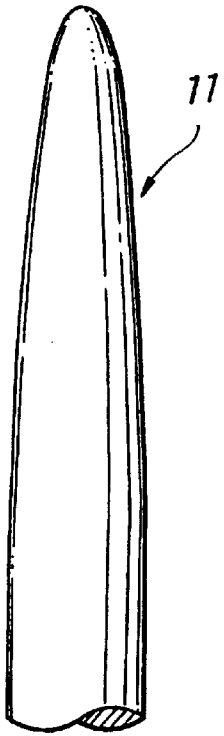

Referring now to the drawings, wherein like reference numerals designate identical or corresponding parts throughout the several views, one embodiment of a toothbrush according to the present invention will now be described. FIG. 1 is a side view of this embodiment, FIG. 2 is a perspective view showing a head portion in this embodiment, FIG. 3 is a side view showing bristles according to this embodiment, and FIG. 4 is a side view showing distal ends of the first and second bristles according to this embodiment when brushing.

Figure 2:
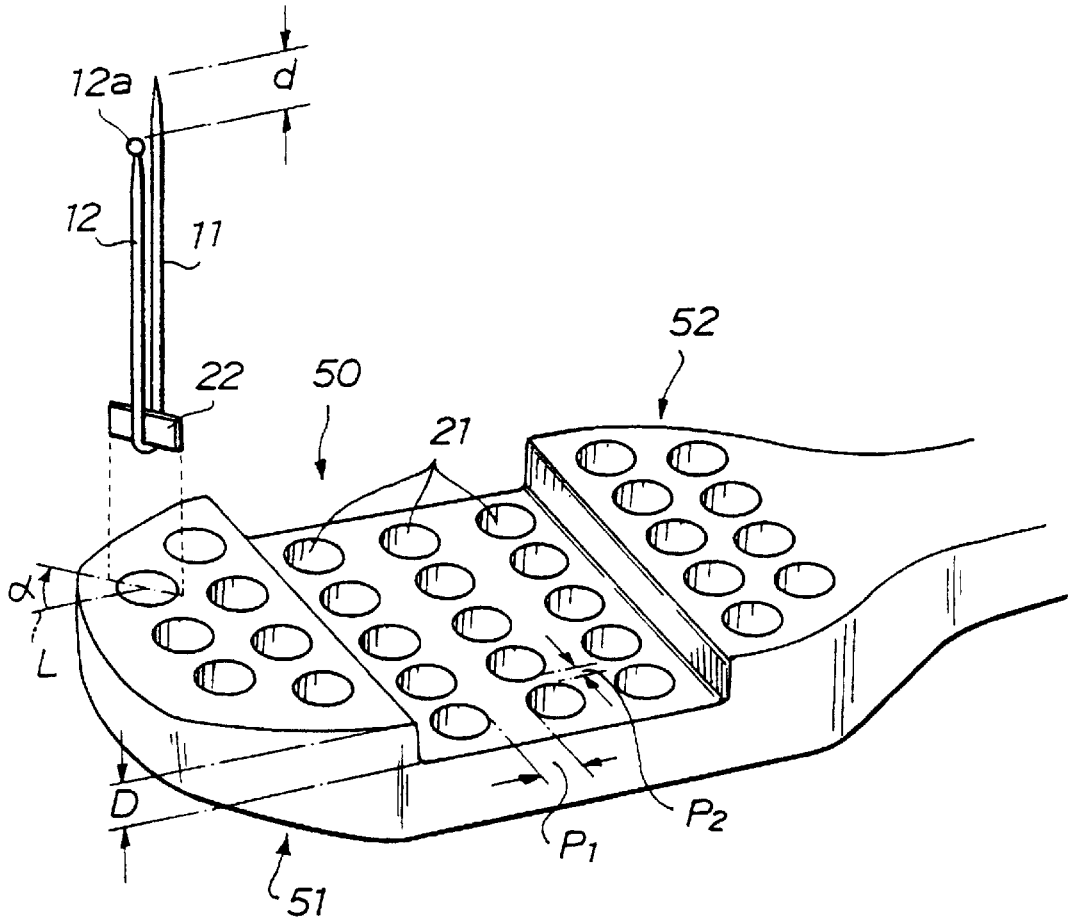
FIG. 2 is a perspective view showing a head portion in the above one embodiment according to the present invention.

As shown in FIG. 1 and FIG. 2, the toothbrush according to the present invention includes a plurality of tufts 1 each including a plurality of bristles, the tufts 1 being embedded respectively in bored holes 21, 21 . . . which are formed in a head portion 2. The toothbrush of this embodiment is not different from the related toothbrushes in this respect.

As shown in FIG. 2, the toothbrush of this embodiment has the features that the tufts 1 comprise a plurality of first bristles 11 which are tapered towards their distal ends, and a plurality of second bristles 12 which are likewise tapered towards their distal ends and have a ball-like portion 12*a* at the distal ends. The foremost ends of the first bristles 11 are located in a position which is higher than the foremost ends of the second bristles 12.

It should be noted that although FIG. 2 shows only one each of the first bristle 11 and the second bristle 12 for the sake of clarity of the construction of the head portion 2, a plurality of the first bristles 11 and a plurality of the second bristles 12 are, in actual practice, embedded respectively in the bored holes 21 as shown in FIG. 1.

The toothbrush according to this embodiment will be described in more detail. As shown in FIG. 1, the toothbrush of this embodiment includes, as in the ordinary toothbrushes, the head portion 2 with a plurality of the tufts 1, 1 . . . embedded therein, a handle portion 4 to be gripped in use, and a neck portion 3 interposed therebetween for connecting the head portion 2 and the handle portion 4 together.

The bristles 11, 12 embedded in the bored holes 21, 21 . . . are made of polybutylene terephthalate (PBT), nylon (6-12, 6-10, 6-6), polypropylene, or the like. Each bristle is folded generally at its center into two parts so that one of the two parts forms the first bristle 11 and the other part forms the second bristle 12, and is inserted and embedded in the corresponding bored hole 21 with its folded part supported by a flat plate 22 as shown in FIG. 2.

It should be noted that although FIG. 2 shows only one each of the first bristle 11 and second bristle 12 for the sake of clarity of the construction, a plurality of such first and second bristles 11, 12 are, in actual practice, embedded respectively in the bored holes 21.

As shown in FIG. 2 and FIG. 3, the first bristles 11 are tapered towards their distal ends. The first bristles 11 are tapered by mechanical means such as a grinder or by chemical means through chemical treatment under usual practice. In this embodiment, the first bristles 11 and the second bristles 12 are tapered by mechanical means as later described in detail.

The first bristles 11 are preferably from 9 mm to 13 mm in height h. If the height h of the first bristles 11 are less than 9 mm, the first bristles 11 become extremely difficult to be flexed to thereby degrade massaging performance and cleansing performance. On the contrary, if the height h of the first bristles 11 are more than 13 mm, the bristles interfere when brushing and the stiffness of the bristles 11 is overly decreased to degrade massaging performance and cleansing performance.

The thickness of the non-tapered portions of the first and second bristles 11, 12 is preferably from 0.15 mm to 0.30 mm in diameter. If the thickness is less than 0.15 mm in diameter, the stiffness of the bristles 11, 12 is overly decreased to degrade massaging performance and cleansing performance, and the bristles are liable to be cut and badly worn to sacrifice the long service life. On the contrary, if the thickness is greater than 0.30 mm in diameter, the stiffness is overly increased to degrade massaging performance and cleansing performance. Viewing the massaging performance and cleansing performance, it is preferred that about from 9 to 25 pieces of the first and second bristles 11, 12 in combination are embedded in each bored hole 21 (although that is also under influence of the relation between the largeness of each bored hole 21 and the thickness of the bristles 11, 12).

As shown in FIGS. 5(*a*)–5(*e*), the first bristles 11 may be tapered in various forms. In the example of FIG. 5(*a*), the first bristle 11 is gradually arcuately tapered. In the example of FIG. 5(*b*), the first bristle 11 is linearly tapered. In the example of FIG. 5(*c*), the first bristle 11 is tapered at its part near the distal end. In the examples of FIG. 5(*d*) and FIG. 5(*e*), the first bristle 11 is steppingly tapered in two stages.

Although the first bristles 11 may take any optional tapered forms as mentioned above, it is preferred that the forms are determined in a way to satisfy the following relation (I).

$$r(x)=a\{(L-x)/L\}^n \quad \text{(I)}$$

where "r(x)" is a function of x and represents a radius of a circular cross-section of the bristle, "x" represents a length from the base of the bristle, "L" represents a length of the bristle from its base to its distal end, "a" represents a value of"r(0)"(sectional radius in case x=0), and "n" represents a factorial coefficient. In the case of this invention, the factorial coefficient "n" is a value in a range from 0.29 to 0.51.

In the above equation (I), the bristle takes a form more resembling a circular column as "n" takes a value closer to 0, and the bristle takes a form more resembling a cone as "n" takes a value closer to 1. In the case of this embodiment, "n" takes a value in the range of from 0.29 to 0.51 and therefore, each first bristle 11 has a distal end of a streamline-like form.

Since the first bristle 11 takes a tapered form as indicated by the above equation (I) in case the factorial coefficient "n" is from 0.29 to 0.51, the toothbrush according to this embodiment readily enters into the interproximal areas and the periodontal areas, not overly hard and therefore, is comfortable in sense of feel, has a stiffness which is suitable to massage the gums, and has a satisfactory long service life.

If the factorial coefficient "n" is less than 0.29, each of the first bristles 11 takes a form more resembling a circular column, and the stiffness of the first bristles 11 are overly increased to provide a hard sense of feel. Moreover, it causes the second bristles 12 to be somewhat raised from the surfaces of the teeth when brushing, instead of appropriately touching the surfaces. Accordingly, the first bristles 11 are difficult to co-act with the second bristles 12, so that cleansing performance and massaging performance tend to be degraded. On the contrary, if the factorial coefficient "n" is more than 0.51, each first bristle 11 takes a form more resembling a circular cone and the stiffness is overly decreased. As a consequence, the first bristle 11 is overly flexed to enter between the second bristles 12 and the teeth, and between the second bristles 12 and the gums when brushing. Accordingly, the first bristles 11 are difficult to co-act with the second bristles 12, so that cleansing performance and massaging performance tend to be degraded. It is preferable that the factorial coefficient "n" takes a value in a range from 0.33 to 0.40, because the service life is increased.

Surface roughness Ra of each first bristle 11 at an area of from 30% to 80% of its overall length near its distal end is from 0.5 $\mu$m to 1.5 $\mu$m. In one example, this measurement of Ra is carried out with the use of a laser type surface configuration measuring microscope. Although FIG. 3 shows one example of a bristle which is folded generally at its center into two parts so that one of the two parts forms the first bristle 11 and the other part forms the second bristle 12, the bristles of the toothbrush according to this embodiment are, in actual practice, ground into a tapered form after the bristles are embedded.

Since each first bristle 11 takes a tapered form and the above-mentioned surface roughness within the aforementioned range, its distal end portion readily enters into the interproximal areas and the periodontal areas, and it is excellent in cleansing performance. Moreover, since the distal end is readily flexed, it is comfortable in sense of feel. In addition, although the distal end is readily flexed, dental plaque and dirt are efficiently scraped off with its side face.

On the other hand, the second bristles 12 are formed at their distal ends with the ball-like portions 12*a* and tapered towards their distal ends as shown in FIG. 2 and FIG. 3. In order to form a ball-like portion at the distal end of the tapered bristle, the distal end of the bristle is heated to form the ball-like portion after the bristle is preliminarily tapered, or the bristle is tapered by chemical treatment or mechanical means such as a grinder after the ball-like portion is formed on a circular column like bristle. The term "ball-like portion" used here refers to one in which the maximum lateral outer diameter of the ball-like portion is larger than the outer diameter of the base portion of the ball-like portion.

The maximum lateral outer diameter of each ball-like portion 12*a* which is formed at the distal end of the second bristle 12, is preferably from 0.15 mm to 0.38 mm. If it is less than 0.15 mm, a sufficient massaging effect is difficult to obtain and the effect for scraping off dirt and plaque on the surfaces of the teeth and gums is difficult to obtain. On the contrary, if it is more than 0.38 mm, manufacture becomes difficult and in addition, each tuft 1 of the bristles becomes difficult to flex, thus it becomes unpractical to use the toothbrush.

Figures 6A, 6B, 6C, 6D, 6E:
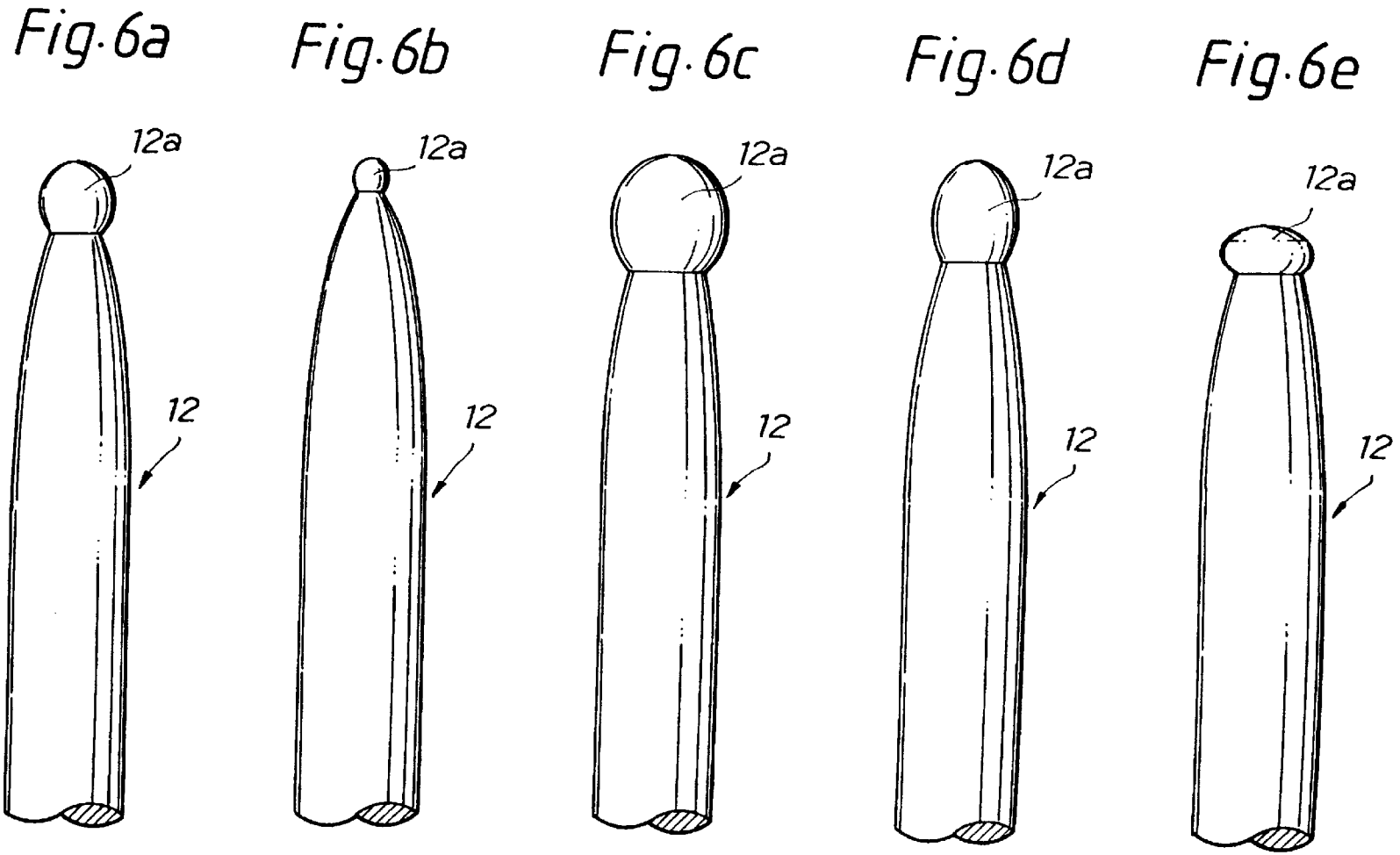
FIGS. 6(*a*)–6(*e*) are side views showing various shapes of ball-like portions formed on the distal ends of the bristles in the toothbrush according to the present invention.

The ball-like portions 12*a* formed at the distal ends of the second bristles 12 may be formed into various forms as shown in FIGS. 6(*a*)–6(*e*). In an examples of FIGS. 6(*a*)–6(*c*), a perfect ball-like portion varies in size. In a further example of FIG. 6(*d*), the ball-like portion 12*a* is vertically expanded. In a further example of FIG. 6(*e*), the ball-like portion 12*a* is horizontally expanded. The tapered form of the second bristles 12 is optional. However, it preferably takes one of the forms obtained by the aforementioned equation (I) as in the case with the first bristles 11. If the second bristles 12 are designed to have the tapered form obtained by the equation (I), a longer service life can be obtained.

Surface roughness Ra of each second bristle 12 at an area of from 30% to 80% of its overall length near its distal end is also from 0.51 $\mu$m to 1.5 $\mu$m. Since each second bristle 12 takes a tapered form and the above-mentioned surface roughness within the aforementioned range, its distal end portion readily enters into the interproximal areas and the periodontal areas, and it is excellent in cleansing performance. Moreover, since the distal end is readily flexed, it is comfortable in sense of feel. In addition, although the distal end is readily flexed, dental plaque and dirt are efficiently scraped off with its side face.

The head portion 2 has a stepped configuration in which its central portion 50 is recessed (FIG. 2). Two rows respectively of three pieces and four pieces of the bored holes 21, 21 . . . are formed in its forward area 51, three rows each of five pieces of the bored holes 21, 21 . . . are formed in its central area 50, and two rows respectively of five pieces and four pieces of the bored holes 21, 21 . . . are formed in its rearward area 52.

Each bored hole 21 is designed to have a diameter from 1.2 mm to 2.4 mm, though a good range of the diameter depends on the thickness and hardness of the bristles 11, 12 to be embedded. If the diameter is less than 1.2 mm, one such tuft 1 of the bristles is overly reduced in stiffness. Therefore, massaging performance and cleansing performance are degraded. On the contrary, if the diameter is more than 2.4 mm, one such tuft 1 of the bristles is overly increased in stiffness. Therefore massaging performance and cleansing performance are degraded.

A step "D" formed on the central portion 50 of the head portion 2 is provided so that the tufts 1, 1 . . . of the bristles embedded in the higher stage (forward area 51 and rearward area 52) may have a greater grade of stiffness than that of the tufts 1, 1 . . . embedded in the lower stage (central portion 50). Accordingly, cleansing performance is enhanced by the tufts 1. Since the tufts 1 of the bristles embedded in the lower stage has a lower grade of stiffness than that of the tufts 1 embedded in the higher stage, the toothbrush as a whole is not overly increased in stiffness and therefore, massaging performance and the sense of feel are not degraded.

The step D is preferably from 0.5 mm to 3.0 mm. If it is less than 0.5 mm, no difference in grade of stiffness is created between the tufts 1 embedded in the higher stage (areas 51 and 52) and the tufts 1 embedded in the lower stage (portion 50). On the contrary, if it is more than 3.0 mm, since the difference in grade of stiffness between the tufts 1 embedded in the higher stage (areas 51 and 52) and the tufts 1 embedded in the lower stage (portion 50) is overly increased, it becomes difficult to enhance cleansing performance without degrading massaging performance and the sense of feel.

The bored holes 21, 21 . . . are arranged preferably at vertical intervals of from (as indicated by $P_1$ of FIG. 2) 1.2 mm to 3.0 mm, and at lateral intervals of from (as indicated by $P_2$ of FIG. 2) 0.75 mm to 1.5 mm. If the intervals $P_1$ and $P_2$ are less than 1.2 mm and 0.75 mm, respectively, the adjoining tufts 1, 1 are too near to flex and the stiffness as a whole is overly increased to thereby degrade massaging performance and cleansing performance. On the contrary, if the intervals $P_1$ and $P_2$ are more than 3.0 mm and 1.5 mm, respectively, the adjoining tufts 1, 1 are so far that the tufts 1, 1 are readily flexed and as a result, the stiffness as a whole is overly decreased to thereby degrade massaging performance and cleansing performance.

With respect to the ratio of area occupied by the bored holes 21, 21 . . . on the surface of the head portion 2, the ratio is preferably from 20% to 35%. If the ratio is less than 20%, the tufts 1, 1 . . . are too rare on the top of the head portion 2 and the stiffness as a whole is overly decreased to degrade massaging performance and cleansing performance. On the contrary, if the ratio is more than 35%, the tufts 1, 1 . . . are too dense on the top of the head portion 2 and the stiffness as a whole is overly increased to degrade massaging performance and cleansing performance.

Though the length of the first bristles 11 at the forward area 51 and the rearward area 52 of the head portion 2 is different from that of the first bristles 11 at the central portion 50 of the head portion 2, the distal ends of all the first bristles 11 are generally on the same level of height. Similarly, though the length of the second bristles 12 at the forward area 51 and the rearward area 52 of the head portion 2 is different from that of the second bristles 12 at the central portion 50 of the head portion 2, the distal ends of all the second bristles 12 are generally on the same level of height.

As previously mentioned, a step "d" is formed between the distal end of each first bristle 11 and the distal end of each second bristle 12. The step "d" is set to from 0.5 mm to 4.00 mm. The step "d" is provided to make it easy for the distal ends of the first bristles 11 to flex as shown in FIG. 4 during brushing. Also, owing to the provision of the step "d", a comfortable sense of feel is obtainable and the distal ends of the first bristles 11 can easily enter the interproximal areas and the periodontal areas in order to scrape off dirt and dental plaque therefrom. Further, the ball-like portions 12*a* of the second bristles 12 provide a favorable massaging effect to the gums, and dirt and dental plaque accumulated on the surfaces of the teeth and gums can be scraped off by the ball-like portions 12*a*. Furthermore, since the second bristles 12 are tapered, only the distal end portions of the second bristles 12 can easily be flexed without degrading cleansing performance and massaging performance, thereby providing a more comfortable sense of feel and a long service life of the bristles.

If the step "d" is less than 0.5 mm, the distal ends of the first bristles 11 are not flexed but merely allowed to contact the surfaces of the teeth and gums simultaneous with the ball-like portions 12*a* of the second bristles 12. Accordingly, the sense of feel is not enhanced. Further, since the distal ends of the first bristles 11 have difficulty in entering the interproximal areas and the periodontal areas, it is difficult to enhance the cleaning performance. On the contrary, if the step "d" is more than 4.0 mm, the second bristles 12 interfere with the distal ends of the first bristles 11 to thereby make it impossible to provide for a sufficient massaging effect. Moreover, since brushing is made only by the first bristles 11 having a smaller grade of stiffness, cleansing performance cannot be enhanced.

In the case of this embodiment, since the bristles each having the first bristles 11 and the second bristles 12 formed on opposite ends of the bristle folded into two parts are used for forming each tuft 1, many first bristles 11 are located on one side of each tuft 1 and many second bristles 12 are located on the other side. Also, in all of the tufts 1, fit angles $\alpha$ (see FIG. 2) of the flat plate 22 are evenly arranged with respect to a longitudinal axis L of the toothbrush.

According to the toothbrush of this embodiment thus constructed, the first bristles 11 are each formed in a tapered form and their distal ends project further than the distal ends of the second bristles 12 with the step "d". Therefore, the first bristles 11 are readily flexed only at the distal ends, without decreasing the stiffness of individual bristles. Further, the first bristles 11 can contact the teeth and the gums earlier than the second bristles 12 so that a comfortable sense of feel can be provided when brushing. Moreover, the distal ends of the first bristles 1I readily enter into the interproximal areas and the periodontal areas to thereby efficiently remove dirt and dental plaque from the teeth. In addition, the distal ends of the first bristles 11 can easily massage the gums near the interproximal areas and periodontal areas which were difficult to be massaged in the conventional manner.

That is, the toothbrush according to this embodiment is comfortable in sense of feel rendered to the teeth and gums during brushing. It is excellent not only in cleansing performance of the surfaces of the teeth and gums but also in cleansing performance of the interproximal areas and the periodontal areas. Moreover, the toothbrush of this embodiment is excellent in the massaging effect of the gums including those parts in the interproximal areas which would otherwise be difficult to be massaged. Furthermore, its bristles have a satisfactory long service life. The toothbrush according to this embodiment includes all of those effects.

A device and procedures for forming the bristles in tapered form and finishing the side faces of the bristles to the above-mentioned surface roughness at one stage of manufacturing a toothbrush according to this embodiment will now be briefly described. The toothbrush according to this embodiment is manufactured from a toothbrush obtained by folding bristle members each of which has a column-like first end and a column-like second end having a ball-like portion at its foremost end into two parts generally at the center, and embedding them respectively in the bored holes 21 with the use of the flat plates 22. Then, the bristles of this toothbrush are ground into a tapered form by a wire brush. Subsequently, they are ground by a nylon brush so that their side faces are caused to have the above-mentioned surface roughness.

Figure 7:
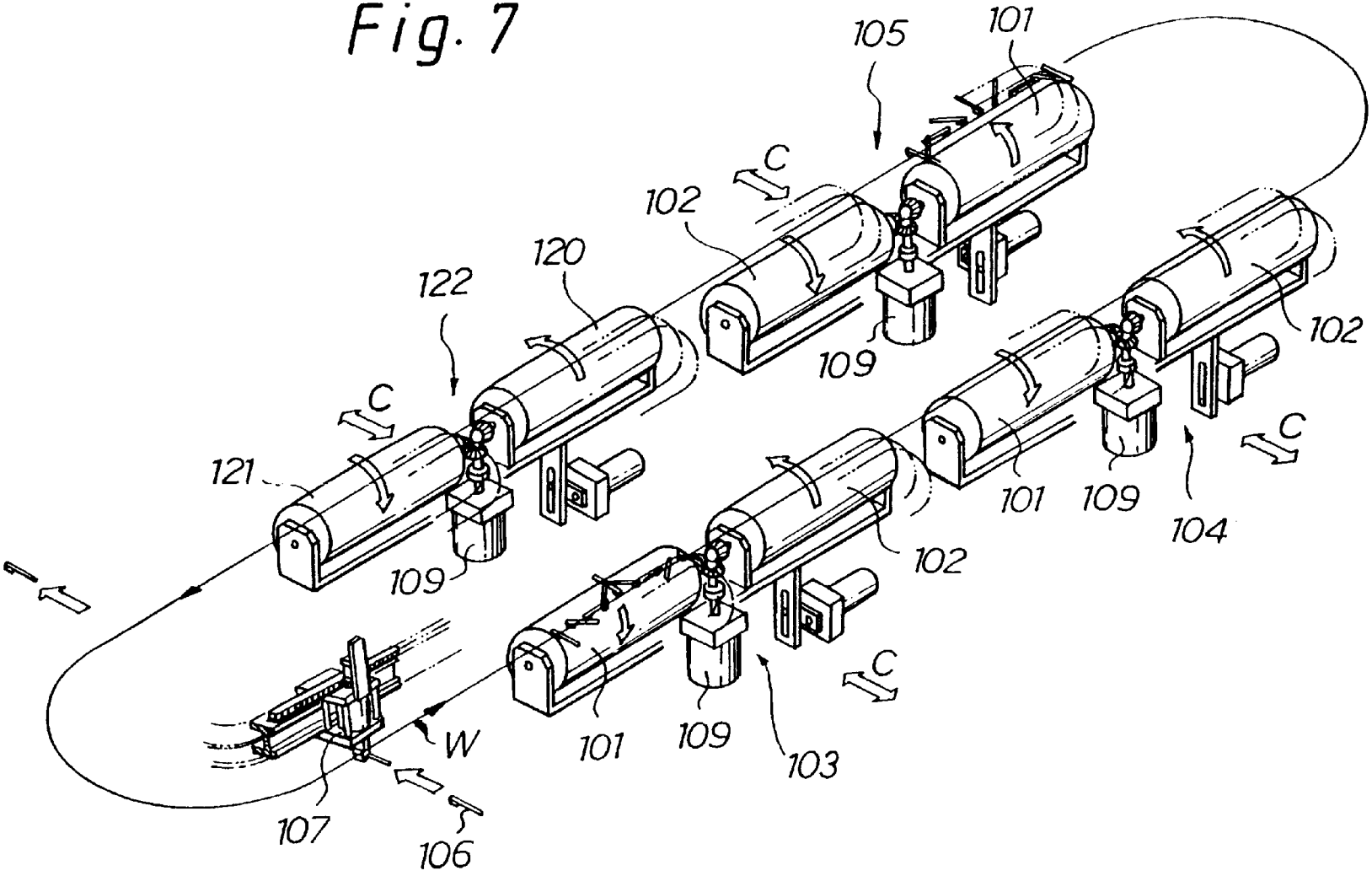
FIG. 7 is a perspective view showing a construction of an abrasive device used for manufacturing a toothbrush of the present invention.
Figure 8:
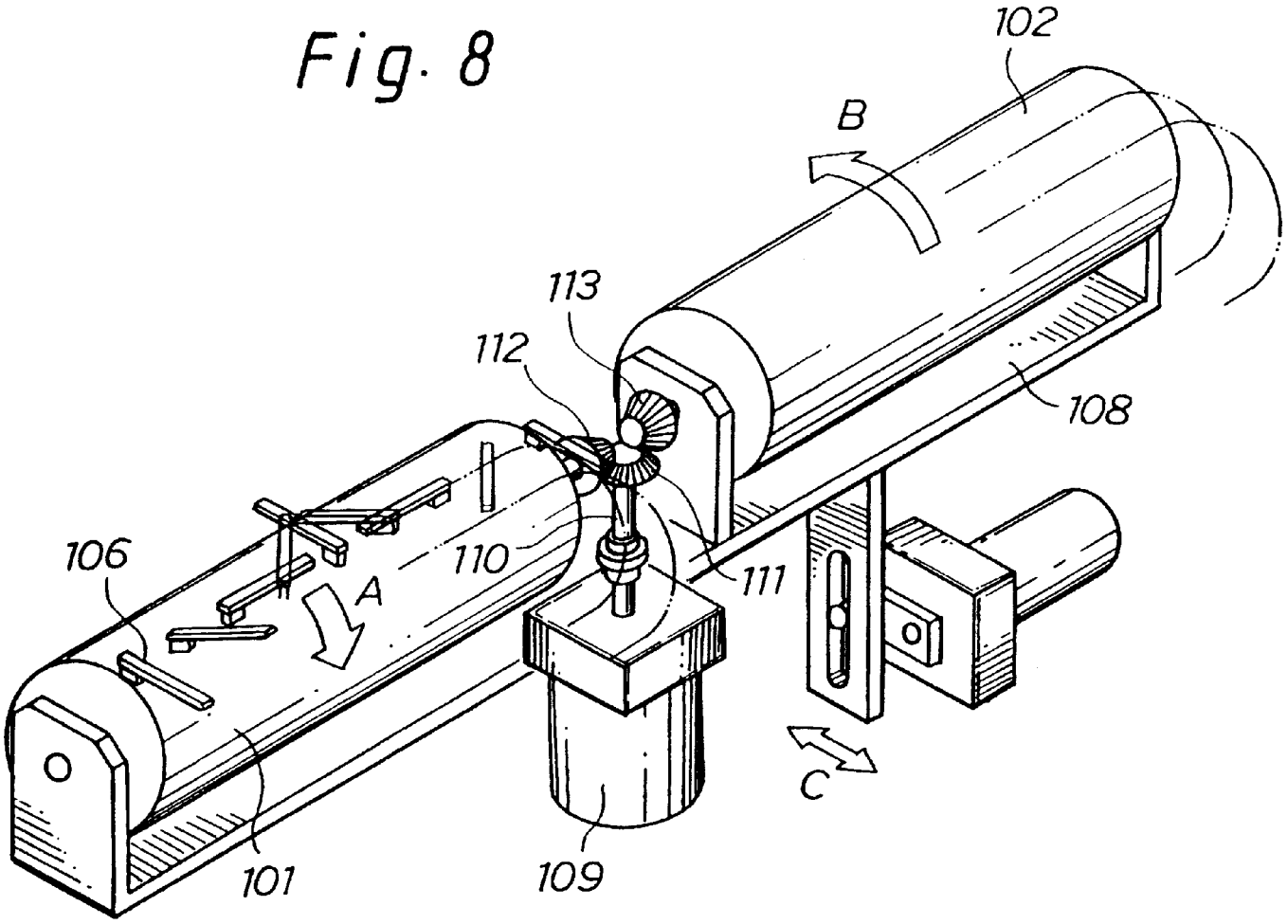
FIG. 8 is an enlarged perspective view showing the brush portion of the abrasive device used for manufacturing a toothbrush of the present invention.

As shown in FIG. 7 and FIG. 8, the abrasive device used for manufacturing a toothbrush according to this embodiment includes first abrasive means 103 having a pair of cylindrical wire brushes 101, 102 which rotate in different directions, second and third abrasive means 104 and 105, and moving means 107 for causing a distal end of the fiber material to contact the rotating wire brushes 101 and 102, so that the toothbrush 106 is gradually moved in the longitudinal direction of the wire brushes 101, 102 while planarly rotating the toothbrush 106 on the wire brushes 101, 102. Fourth abrasive means 122 having a pair of cylindrical nylon brushes 120, 121, which rotate in different directions, is disposed at a forward location of the third abrasive means 105.

The first abrasive means 103 through the third abrasive means 105 each have a pair of cylindrical wire brushes 101, 102 as shown in FIG. 8. The wire brushes 101, 102, in the form of one pair as one set, are rotatably mounted on a brush mounting base 108 and caused to rotate in different directions as indicated by arrows A and B of FIG. 8, by a brush rotation motor 109.

That is, as shown in FIG. 8, the pair of wire brushes 101, 102 includes rotation transmitting gears 112, 113 engageable with a bevel gear 11 disposed on a distal end of a drive shaft 110 of the brush rotating motor 109. The arrangement being such that rotation of the brush rotating motor 109 is transmitted to the wire brushes 101, 102 through the rotation transmitting gears 112, 113, so that the wire brushes 101, 102 will rotate in different directions. Accordingly, the wire brush 101 is rotated in the direction as indicated by an arrow A of FIG. 8, while the other wire brush 102 is rotated in the opposite direction as indicated by an arrow B of FIG. 8.

Figure 9:
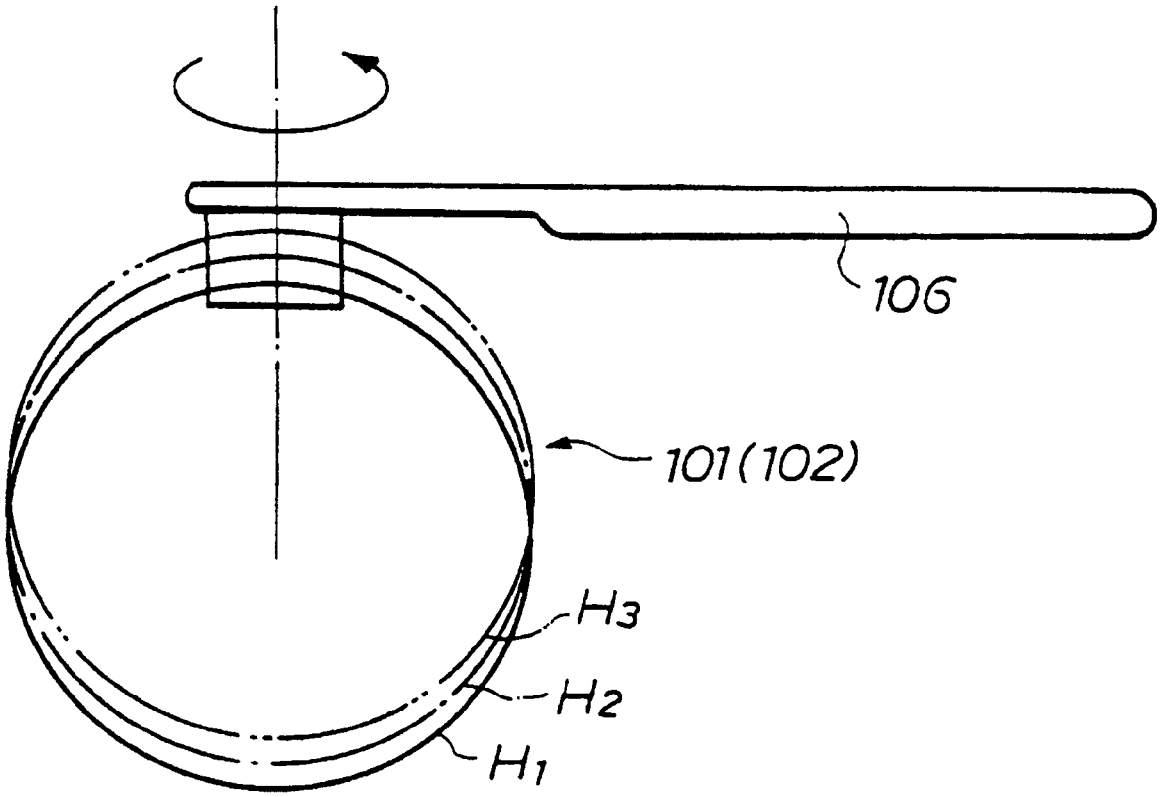
FIG. 9 is a side view showing one mode for steppingly grinding a toothbrush in the abrasive device used for manufacturing the toothbrush of the present invention.

The wire brushes 101, 102 are swung generally in a perpendicular direction (direction as indicated by an arrow C of FIG. 7) to the direction of movement of the toothbrush 106 which moves in a way to draw a loop as indicated by an arrow W of FIG. 7. As shown in FIG. 9, the first abrasive means 103 through the third abrasive means 105 thus constructed are arranged in predetermined position along the direction of movement of the toothbrush 106 in order as shown in FIG. 7, so that the contacting height between the bristles of the toothbrush 106 and the wire brushes 101, 102 is gradually increased.

That is, the wire brushes 101, 102 in the first abrasive means 103 are located in the position indicated by a solid line $H_1$ of FIG. 9, the wire brushes 101, 102 in the second abrasive means 104 are located in the position indicated by a one-dot chain line $H_2$, and the wire brushes 101, 102 in the third abrasive means 105 are located in the position indicated by a two-dot chain line $H_3$, such that the height of the wire brushes 101, 102 are, either steppingly or steplessly, increased from the first abrasive means 103 to the second abrasive means 104 and then to the third abrasive means 105.

As shown in FIG. 7, the abrasive means 103 through 105 are arranged in the direction of movement of the toothbrush 106 as follows. That is, the first abrasive means 103 is arranged at a rearward location of the supplying toothbrush 106 before the toothbrush 106 is ground, the second abrasive means 104 is arranged at a forward location of the first abrasive means 103 at a predetermined space, and the third abrasive means 105 is arranged at a location which faces with the second abrasive means 104.

The fourth abrasive means 122 is provided to make a smooth grinding surface because the grinding surface ground merely by the wire brushes 101, 102, is not smooth enough.

The nylon brushes 120, 121 have abrasive grains kneaded to the surfaces. Since the fourth abrasive means 122 has the same construction as the first abrasive means 103 through the third abrasive means 105 except that the brushes are nylon brushes, description of the common parts is omitted.

Next, the procedures for grinding the toothbrush 106 using the above device will be described briefly. When the toothbrush 106, which is not yet ground into the tapered form as mentioned above, is supplied to the device, the toothbrush 106 is pinched at its head portion by a toothbrush holder, not shown, with the bristles facing downward. The toothbrush 106 is gradually and continuously moved, by the moving means 107, in the direction as indicated by an arrow W of FIG. 7. At that time, as shown in FIG. 8, the toothbrush 106 is rotated about the head portion in a horizontal plane. Then, as shown in FIG. 7, the toothbrush 106 contacts the wire brushes 101, 102 of the first abrasive means 103 rotating at a high speed but in opposite directions, and gradually moves in the longitudinal direction of the wire brushes 101, 102 while planarly rotating on the wire brushes 101, 102.

In this first abrasive means 103, the toothbrush 106 contacts the wire brushes 101, 102 which are set to position as indicated by a solid line $H_1$ of FIG. 9. That is, the foremost ends of the bristles of the toothbrush 106 contact the wire brushes 101, 102. Then, the toothbrush 106 is ground by the wire brushes 101, 102 which swing in a generally perpendicular direction to the direction of movement of the toothbrush 106 as indicated by the arrow C of FIG. 7, through interaction of rotation and swinging of the wire brushes 101, 102.

During the time when the toothbrush 106 contacts the wire brushes 101, 102, cold water is introduced in order to reduce a possible deformation of the bristles and wash out the grinding powders. The cold water circulates after the grinding powers are recovered through a filter such as non-woven fabric and paper. When the grinding is finished in the first abrasive means 103, the toothbrush 106 is ground by the second abrasive means 104 next arranged as shown in FIG. 7. In this second abrasive means 104, the toothbrush 106 contacts the wire brushes 101, 102 which are set to the position indicated by the one-dot chain line $H_2$ of FIG. 9. That is, the toothbrush 106 contacts the wire brushes 101, 102 at its area extending slightly towards its base from its distal end. The toothbrush 106 is ground likewise by the wire brushes 101, 102 through interaction of rotation and swinging of the wire brushes 101, 102.

When the grinding is finished in the second abrasive means 104, the toothbrush 106 is ground by the third abrasive means 105 next arranged as shown in FIG. 7. In this third abrasive means 105, the toothbrush 106 contacts the wire brushes 101, 102 which are set to the position indicated by the two-dot chain line $H_3$ of FIG. 9. That is, the toothbrush 106 contacts the wire brushes 101, 102 at its area extending slightly towards its base from its distal end. And the toothbrush 106 is ground likewise by the wire brushes 101, 102 through interaction of rotation and swinging of the wire brushes 101, 102.

When the grinding is finished in the third abrasive means 105, the toothbrush 106 is ground by the fourth abrasive means 122 next arranged as shown in FIG. 7. In this fourth abrasive means 122, the toothbrush 106 contacts the nylon brushes 120, 121 which are set to the same position where the wire brushes 101, 102 are set in the third grinding means 105, i.e., the position as indicated by the two-dot chain line $H_3$ of FIG. 9. The toothbrush 106 is ground likewise by the nylon brushes 120, 121 through interaction of rotation and swinging of the nylon brushes 120, 121. The toothbrush 106, for which the grinding is finished via the above-mentioned four grinding processes, is then released from its state held by the toothbrush holder in the moving means 107 and transferred to an outlet port not shown.

According to the toothbrush of this embodiment, it includes the first bristles 11 and the second bristles 12 which are each formed in a tapered form, and those areas of the bristles 11, 12 which are in the range of from 30% to 80% of the overall length from their distal ends, have the above-mentioned surface roughness. Accordingly, the distal ends (particularly, the distal ends of the first bristles 11) readily enter into the interproximal areas and periodontal areas, and an excellent cleansing performance of the interproximal areas and the periodontal areas is also achieved. In addition, there can exhibit an excellent scraping-off effect with respect to the surfaces of the teeth, etc. by the side faces having the above-mentioned surface roughness. Further, the first bristles 11 and the second bristles 12 are each formed in a tapered form, and so the maximum stress can be reduced by scattering the stress generated in the first and second bristles 11, 12. Accordingly, a long service life can be obtained.

To illustrate the advantageous effects of the present invention, the following Test Example was carried out using the invention product, and comparative products 1 and 2.

[Test Products]

Invention product: a toothbrush according to the above-mentioned embodiment

Comparative product 1: a toothbrush in which the second bristles of the tooth brush according to the above-mentioned embodiment are such that ball-like portions are formed at the distal ends of the non-tapered bristles Comparative product 2: a toothbrush in which the second bristles of the tooth brush according to the above-mentioned embodiment are merely tapered without ball-like portions at the distal ends

[Test Example]

Each test product was used for a month by 100 panelists in their twenties, thirties and forties, and then the following questions shown in Table 1 were asked. The figures shown in Table 1 are the percentages of the panelists who answered "yes" to each question.

TABLE 1

Questionnaires and Answer results

| Questionnaires | Test Products | | |
|---|---|---|---|
| | Invention product | Comparative product 1 | Comparative product 2 |
| The interproximal areas can be cleaned well | 88% | 77% | 70% |
| The periodontal areas can be cleaned well | 81% | 78% | 80% |
| Surfaces of teeth can be cleaned well | 82% | 80% | 55% |
| Gums can be massaged well | 78% | 75% | 57% |
| Feel of brushing is good | 86% | 66% | 78% |
| Spread of the distal ends of the bristles are noted (1 month after) | 5% | 24% | 3% |

As is clearly seen from Table 1, the toothbrush of the invention product is excellent, in comparison with the comparative products, in performance of cleansing the interproximal areas, the periodontal areas and the surfaces of teeth. In addition, the toothbrush of the invention product is also excellent, in comparison with the comparative products, in performance of massaging, feel of brushing and the long service life. In connection with spread of the distal ends of the bristles, the answer results show that the comparative product 2 is a little superior to the inventive product. However, the toothbrush of the comparative product 2 is quite inferior to the invention product in performance of cleansing the surfaces of teeth and performance of massaging gums, thus failing to satisfy these performances and the long service life together.

The toothbrush according to the present invention is not limited to the above embodiment. For example, in the above embodiment, since the tufts 1 are each comprised of the bristles as shown in FIG. 3, the number of the first bristles 11 and the number of the second bristles 12, which constitute the tufts 1, are substantially equal. However, the number of the first bristles of a single tuft and the number of the second bristles of a single tuft may not necessarily be equal.

The tufts 1 may be constituted by folding two types of bristles into two parts, the first type of bristles having the first bristles 11 formed on opposite ends thereof and the second type of bristles having the second br sties 12 formed on opposite ends thereof In the above embodiment, although the head portion 2 is of a stepped form having the step D, the head portion 2 may have a flat upper surface.

In the above embodiment, the first bristles 11 are located on one side and the second bristles 12 are located on the other side with reference to the flat plate 22, using a plurality of bristles of FIG. 3. In the alternative, the first bristles 11 and the second bristles 12 may be mixedly located on the same side, using the bristles of FIG. 3. Other parts of the toothbrush of this invention may also be modified according to necessity without departing from the gist of the invention.

Industrial Applicability

The toothbrush according to the present invention is excellent with regard to performance in cleansing the surfaces of teeth and gums, the areas between adjoining teeth, and the marginal areas between the teeth and the gums. The toothbrush according to the present invention is also excellent with regard to performance in massaging gums, is comfortable in the sense of feel, and is satisfactory with regard to providing a long service life of the bristles.

Obviously, numerous modifications and variations of the present invention are possible in light of the above teachings. It is therefore to be understood that within the scope of the appended claims, the invention may be practiced otherwise than as specifically described herein.

We claim:

1. A toothbrush comprising:

a plurality of tufts each comprising a plurality of bristles embedded respectively in a plurality of bored holes formed in a head portion of the toothbrush;

wherein each of said tufts comprises a plurality of first bristles tapered towards distal ends of the first bristles, and a plurality of second bristles tapered towards distal ends of said second bristles, each of said second bristles having a ball-like portion on each of the distal ends of the second bristles, the distal ends of said first bristles being located at a higher position than the distal ends of said second bristles.

2. A toothbrush according to claim 1, wherein said first bristles and said second bristles have a surface roughness of Ra=0.5 $\mu$m to 1.5 $\mu$m at those areas from 30% to 80% of an overall length from the distal ends of the first bristles and the second bristles.

3. A toothbrush according to claim 1, wherein a step between the distal ends of said first bristles and the distal ends of said second bristles is in a range from 0.5 mm to 4.0 mm.

4. A toothbrush according to claim 2, wherein a step between the distal ends of said first bristles and the distal ends of said second bristles is in a range from 0.5 mm to 4.0 mm.

5. A toothbrush according to claim 1, wherein each of said plurality of bristles is folded to form a folded part, a first part and a second part, one of said first and second parts forming said first bristle, and the other of said first and second parts forming said second bristles.

6. A toothbrush according to claim 5, wherein said folded part is embedding in a corresponding one of said bored holes, and said folded part is supported in said corresponding bored hole by a flat plate.

7. A toothbrush according to claim 1, wherein said head portion of the toothbrush comprises a central recessed area, such that lengths of the first and second bristles in the central recessed area of said head portion are longer than lengths of the first and second bristles in remaining areas of said head portion.

* * * * *